US006557745B2

(12) United States Patent
Wang

(10) Patent No.: US 6,557,745 B2
(45) Date of Patent: May 6, 2003

(54) LENGTH ADJUSTABLE TRIGGER ASSEMBLY FOR NAILER

(76) Inventor: Kuan Lin Wang, 11F-2, No.43, Chai-I Street, Taichung City (TW)

( * ) Notice: Subject to any disclaimer, the term of this patent is extended or adjusted under 35 U.S.C. 154(b) by 29 days.

(21) Appl. No.: 09/967,381

(22) Filed: Oct. 1, 2001

(65) Prior Publication Data

US 2003/0019904 A1 Jan. 30, 2003

(30) Foreign Application Priority Data

Jul. 27, 2001 (TW) ..... 90213026 U

(51) Int. Cl.[7] ..... B25C 1/04
(52) U.S. Cl. ..... 227/142; 227/8
(58) Field of Search ..... 227/8, 142

(56) References Cited

U.S. PATENT DOCUMENTS 5,219,110 A * 6/1993 Mukoyama ..... 227/8
5,385,286 A * 1/1995 Johnson, Jr. ..... 227/142
5,579,977 A * 12/1996 Yang ..... 227/8
6,024,267 A * 2/2000 Chen ..... 227/142
6,186,386 B1 * 2/2001 Canlas et al. ..... 227/8
6,209,770 B1 * 4/2001 Perra ..... 227/142
6,454,151 B1 * 9/2002 Wang-Kuan ..... 227/142

* cited by examiner

*Primary Examiner*—Scott A. Smith
(74) *Attorney, Agent, or Firm*—Charles E. Baxley

(57) ABSTRACT

A trigger assembly for a pneumatic nailer includes a frame having a threaded end on which an end member is threadedly mounted. A spring is biased between the body of the nailer and the frame. An end of a bar is connected to the frame and the other end of the bar is connected to a trigger. A limit member is movably connected to the frame and an engaging member is located on a first end of the limit member. An end member is threadedly mounted to the threaded end and a plurality of notches are defined in an end thereof. The engaging member of the limit member is engaged with on of the notches.

6 Claims, 4 Drawing Sheets

LENGTH ADJUSTABLE TRIGGER ASSEMBLY FOR NAILER

FIELD OF THE INVENTION

The present invention relates to a trigger assembly for a pneumatic nailer wherein the limit member is movably connected to the frame of the assembly and an end is engaged with one of notches in an end collar which is threadedly connected to the frame. The end collar is positioned by the engagement of the limit member.

BACKGROUND OF THE INVENTION

A conventional trigger assembly for a pneumatic nailer generally includes a bar that has one end engaged with the trigger and the other end of the bar is connected to a frame. The frame is movably connected to the body of the nailer and an ejection nozzle of the nailer is located beside the frame. When nailing, the user contacts an end of the frame of the nailer to the object to be nailed and then pushes the nailer toward the object so that the frame is moved backward by the reaction force from the object. The movement of the frame moves the bar and the bar activates the trigger to a ready-to-shoot position. When the trigger is pulled, the nail comes out from the ejection nozzle. In other words, the trigger assembly is a safety means which requires the user to push the end member against the object to activate the trigger. However, the lengths of the ejection nozzles of different specification or brands are different so that the length of the trigger assembly has to be correspondingly adjusted. Although the length of some of the conventional trigger assemblies can be adjusted, it requires a tool such as a spanner. If the user does not have the spanner with the correct specification, the trigger assembly cannot be adjusted.

SUMMARY OF THE INVENTION

In accordance with one aspect of the present invention, there is provided a trigger assembly for a pneumatic nailer and comprises a frame having a threaded end connected to a first end of the frame and a spring is engaged with a second end of the frame. A bar is connected between the first end of the frame and a trigger of the nailer. A limit member is movably connected to the frame and an engaging member is located on a first end of the limit member. An end member is threadedly mounted to the threaded end and a plurality of notches are defined in an end of the end member. The engaging member of the limit member is engaged with on of the notches.

The primary object of the present invention is to provide a trigger assembly for a pneumatic nailer wherein the length of the whole trigger assembly can be adjusted according to practical needs.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
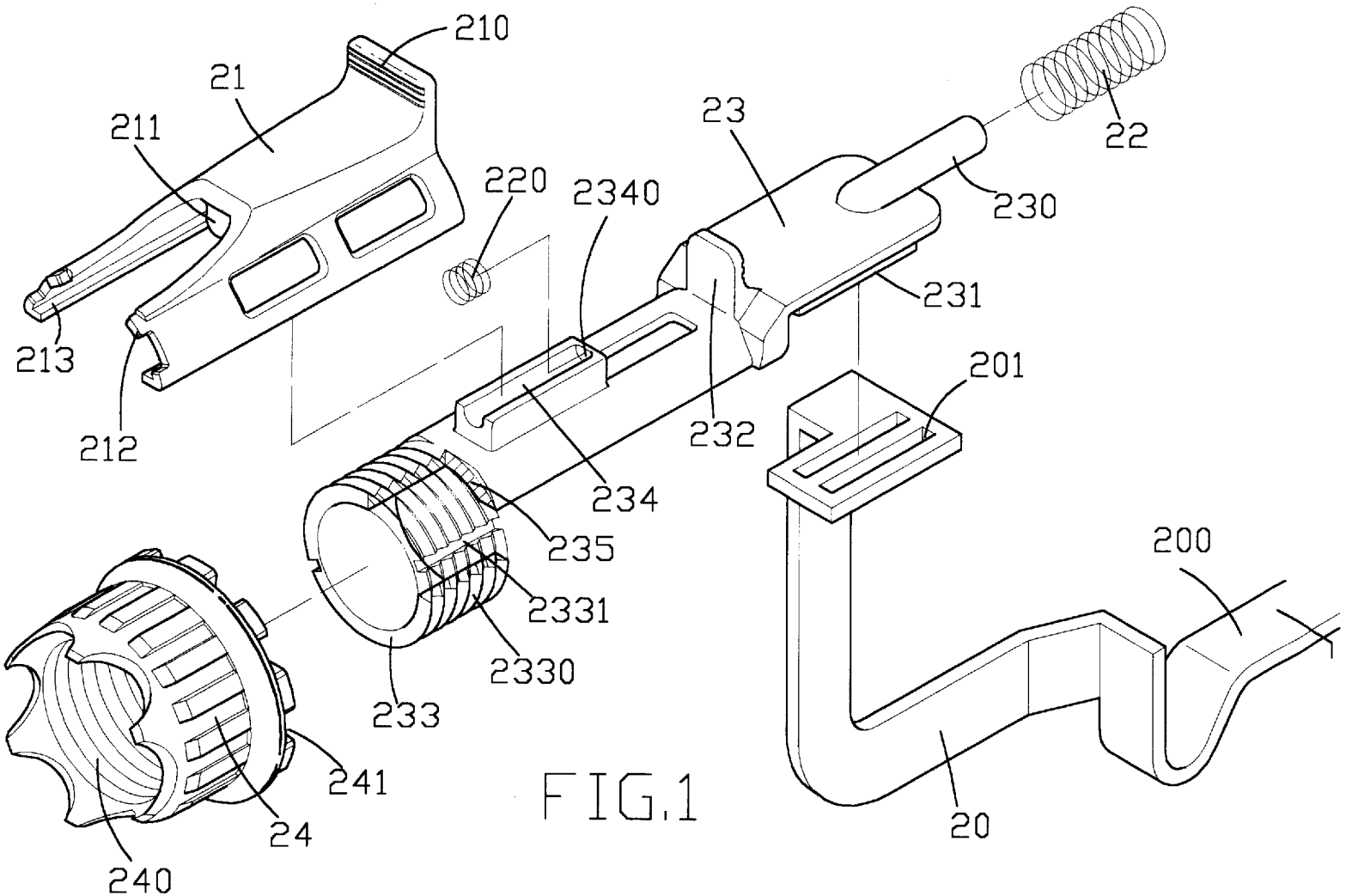
FIG. 1 is an exploded view to show a trigger assembly of the present invention.
Figure 2:
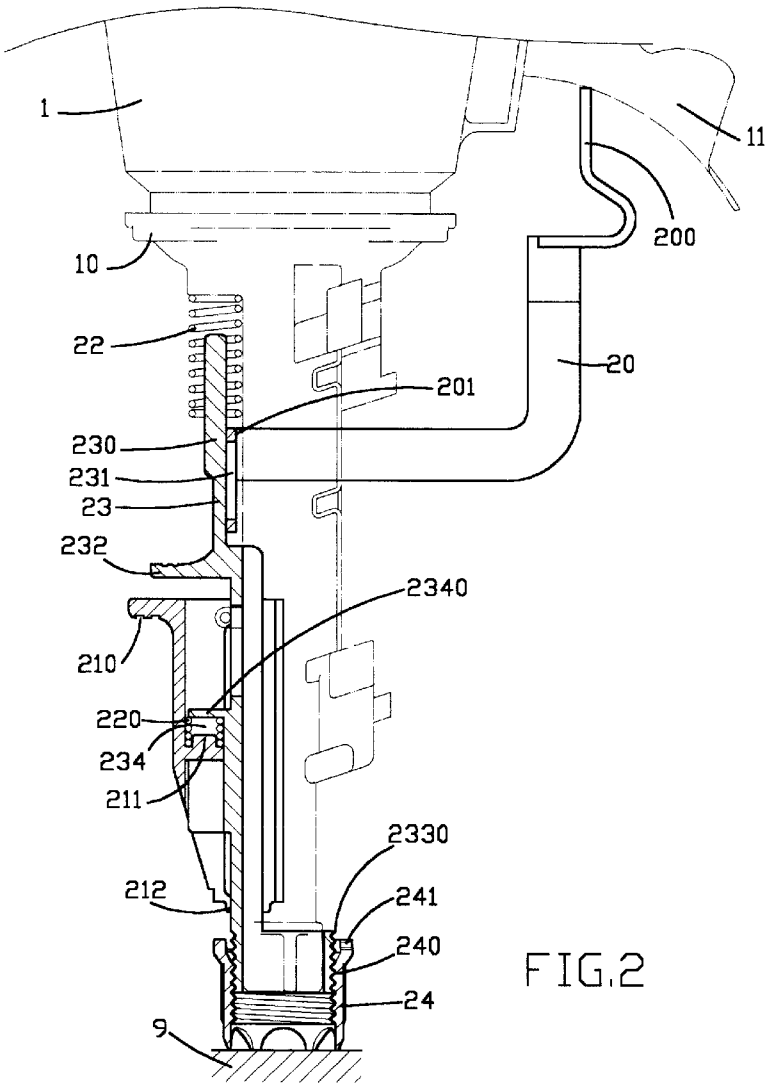
FIG. 2 is a side elevational view to show the trigger assembly of the present invention.
Figure 3:
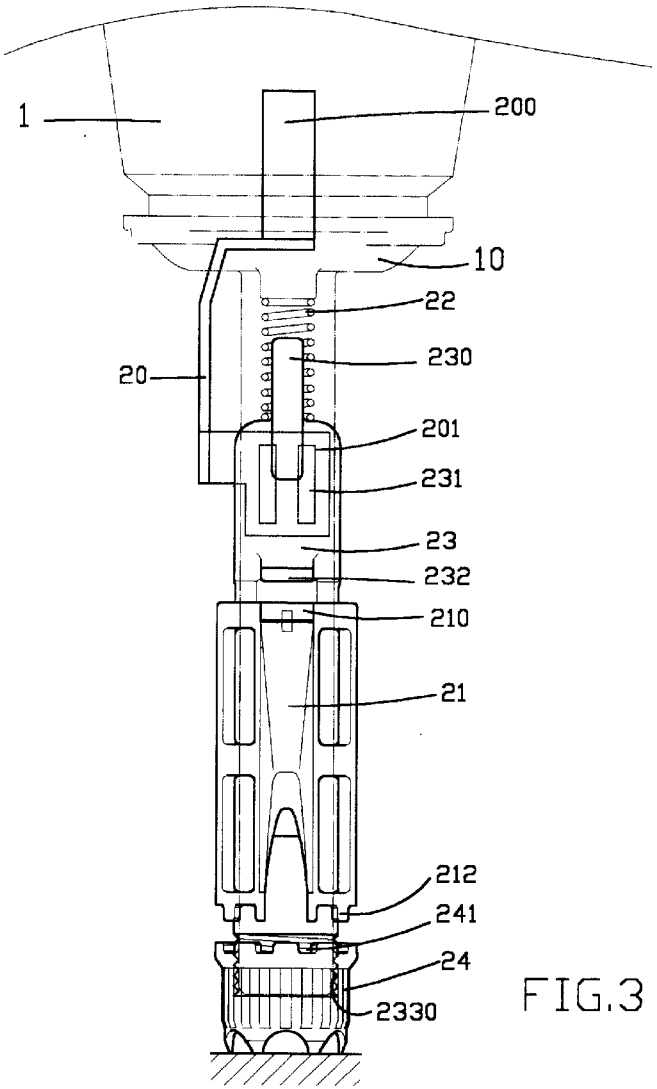
FIG. 3 is another side elevational view to show the trigger assembly of the present invention.

Referring to FIGS. 1 to 3, the trigger assembly of the present invention comprises a frame 23 having a first push plate 232 extending from a top of the frame 23 and a threaded end 233 which is a threaded collar connected to a first end of the frame 23. A rod 230 extends from a second end of the frame 23 and a spring 22 is mounted to the rod 230 and biased between the second end of the frame 23 and a front end 10 of the nailer 1. A bar 20 has two engaging slots 201 defined in a first end thereof and two ribs 231 (only one is shown) connected to the first end of the frame 23 are engaged with the engaging slots 201. A second end 200 of the bar 20 is connected to a trigger 11. The frame 23 has a slot 234 defined therein and the slot 234 is ended at a close end 2340.

Figure 6:
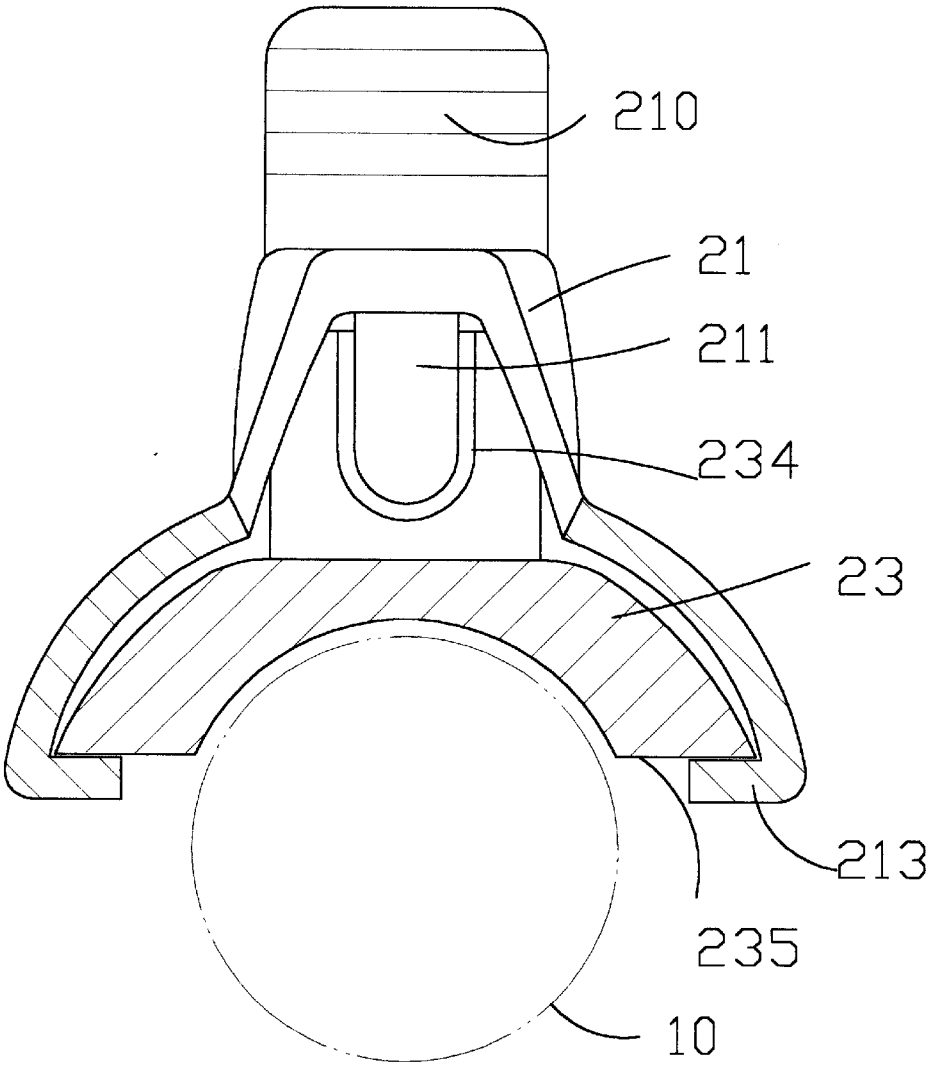
FIG. 6 is a cross sectional view to show the guide flanges of the limit member is engaged with a lower edge of the frame.

A limit member 21 is movably connected to the frame 23 and has a protrusion 211 which is movably received in the slot 234. A spring 220 is biased between the close end and the protrusion 211. A second push plate 210 extends from the limit member 21. An engaging member 212 is located on a first end of the limit member 21 and two guide flanges 213 extend from an inside of the limit member 21. The threaded end 233 has grooves 2331 defined in an outer periphery thereof so that the guide flanges 213 are movably engaged with the grooves 2331, and the guide flanges 213 are engaged with an end of the frame 23 as shown in FIG. 6.

An end member 24 has inner threads 240 which is threadedly mounted to the threads 2330 of the threaded end 233 and a plurality of notches 241 are defined in an end of the end member 24. The engaging member 212 of the limit member 21 is engaged with on of the notches 241.

Figure 4:
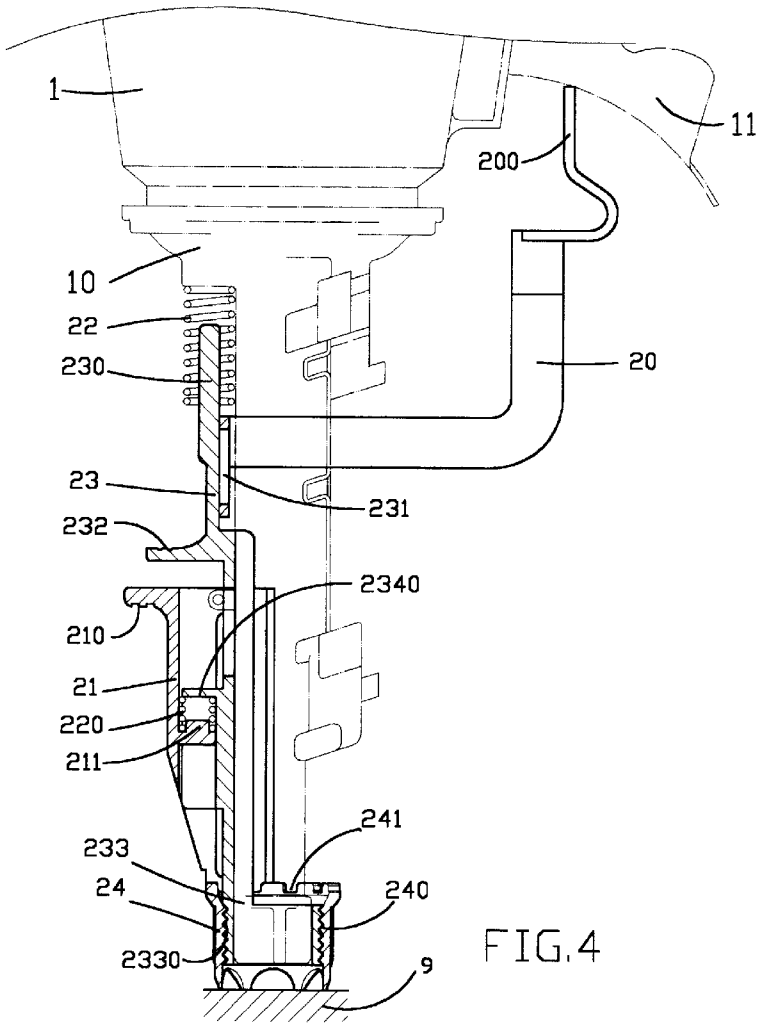
FIG. 4 is a side elevational view to show the trigger assembly of the present invention, wherein the nailer is pushed toward the object to be nailed.
Figure 5:
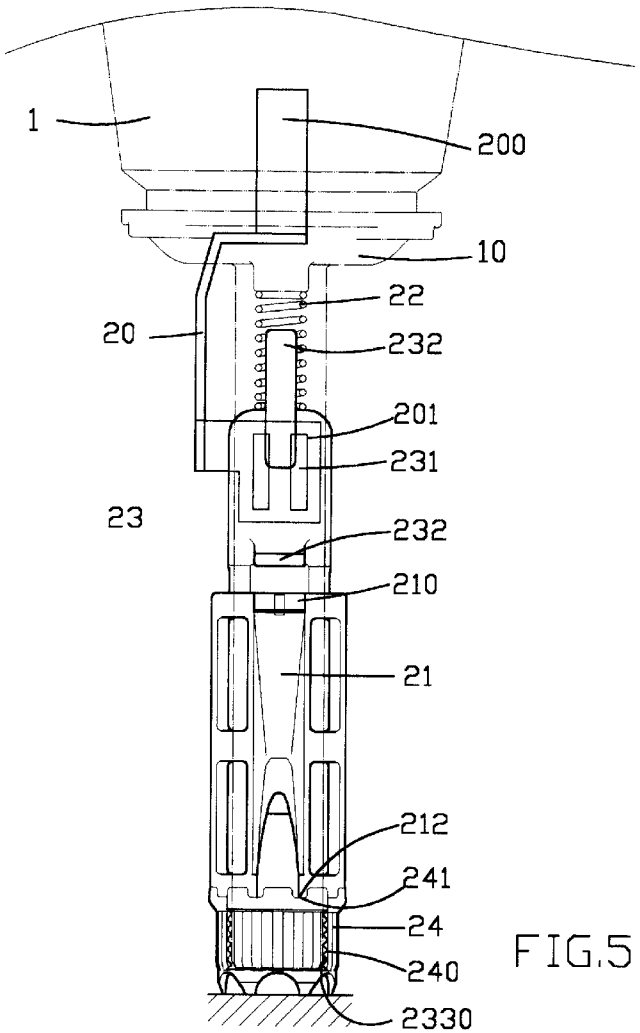
FIG. 5 is another side elevational view to show the trigger assembly of the present invention as shown in FIG. 4.

Referring to FIGS. 4 and 5, when pushing the nailer 1 against the object 9 to be nailed, the frame 23 is pushed toward the nailer 1 so that the ejection nozzle firmly contacts the object 9 and the movement of the frame 23 pushes the bar 20 to activate the trigger 11 which can be pulled to nail the object 9.

When the length of the assembly is to be adjusted, the user pushes the second push plate 210 so as to remove the engaging member 212 from the notch 241 so that the end member 21 can be rotated on the threaded end 233 to adjust the total length of the assembly. The end member 21 is then released to let the engaging member 212 engage one of the notches 241 again. The adjustment needs no tools and is conveniently completely by the user himself or herself.

While we have shown and described the embodiment in accordance with the present invention, it should be clear to those skilled in the art that further embodiments may be made without departing from the scope of the present invention.

What is claimed is:

1. A trigger assembly for a pneumatic nailer, comprising:

a frame having a threaded end connected to a first end of said frame and a spring engaged with a second end of said frame, a bar connected to said first end of said frame and adapted to be connected to a trigger;

a limit member movably connected to said frame and an engaging member located on a first end of said limit member, and an end member threadedly mounted to said threaded end and a plurality of notches defined in an end of said end member, said engaging member of said limit member engaged with one of said notches.

2. The assembly as claimed in claim 1, wherein said frame has a slot defined therein and said limit member has a protrusion which is movably received in said slot.

3. The assembly as claimed in claim 2, wherein said slot has a close end and a spring is biased between said close end and said protrusion.

4. The assembly as claimed in claim 1 further comprising two guide flanges extending from an inside of said limit member and said threaded end having grooves defined in an outer periphery thereof, said guide flanges movably engaged with said grooves.

5. The assembly as claimed in claim 1 further comprising a first push plate extending from said frame.

6. The assembly as claimed in claim 1 further comprising a second push plate extending from said limit member.

* * * * *